US008262441B2

(12) United States Patent
Chang

(10) Patent No.: US 8,262,441 B2
(45) Date of Patent: Sep. 11, 2012

(54) COIN DISPENSING AND STORING DEVICE

(75) Inventor: Hung-Yi Chang, Taipei (TW)

(73) Assignee: International Currency Technologies Corp., Taipei (TW)

( * ) Notice: Subject to any disclaimer, the term of this patent is extended or adjusted under 35 U.S.C. 154(b) by 363 days.

(21) Appl. No.: 12/570,052

(22) Filed: Sep. 30, 2009

(65) Prior Publication Data

US 2011/0076930 A1 Mar. 31, 2011

(51) Int. Cl.
*G07D 1/00* (2006.01)

(52) U.S. Cl. ..... 453/18

(58) Field of Classification Search ..... 453/18–29, 453/39, 44, 45; 221/69, 90, 92, 197, 282, 221/285, 286, 287; 446/8, 13; 206/0.8, 0.81–0.84; 232/1 D, 55, 57, 57.5, 64, 65, 66
See application file for complete search history.

(56) References Cited

U.S. PATENT DOCUMENTS

| | | | | |
|---|---|---|---|---|
| 2,775,947 | A * | 1/1957 | Mosler | 109/47 |
| 4,374,529 | A * | 2/1983 | Kobayashi et al. | 453/17 |
| 2008/0014850 | A1* | 1/2008 | Levasseur et al. | 453/18 |

* cited by examiner

*Primary Examiner* — Mark Beauchaine

(74) *Attorney, Agent, or Firm* — Chun-Ming Sih; HDLS IPR Services

(57) ABSTRACT

A coin dispensing and storing device includes a coin distributing body (10), coin collecting tubes (20), a left rotatable support (30), a pivotal plate (40) and a right rotatable support (50). Coins are received in the coin collecting tubes (20) respectively. The left rotatable support (30) is pivotally connected to one side of the coin distributing body (10). The left rotatable support (30) allows a portion of the coin collecting tubes (20) to be disposed therein. The pivotal plate (40) is pivotally connected to the other side of the coin distributing body (10). The right rotatable support (50) is connected to the pivotal plate (40). The right rotatable support (50) allows the remaining portion of the coin collecting tubes (20) to be disposed therein. The left rotatable support (30) and the right rotatable support (50) can be pivotally received in the coin distributing body (10) or rotated to the outside of the coin distributing body (10). With this arrangement, the operation is labor-saving. Further, the force exerting on the respective rotatable supports can be distributed efficiently to reduce the generation of damage and deformation.

17 Claims, 11 Drawing Sheets

COIN DISPENSING AND STORING DEVICE

BACKGROUND OF THE INVENTION

1. Field of the Invention

The present invention relates to a coin dispensing and storing device, and in particular to a coin dispensing and storing device in which a left rotatable support and a right rotatable support are provided separately.

2. Description of Prior Art

There are many kinds of coin dispensing and storing devices in the market, in which a plurality of coin collecting tubes are provided. The sizes (diameters) of the coin collecting tubes are designed to correspond to the diameters of different coins, thereby storing various coins. For example, in a coin-operated ticket machine, coin exchanger or vending machine in MRT (Mass Rapid Transit) station or railroad station, such a coin dispensing and storing device is used. An operator opens the coin dispensing and storing device periodically to replace nearly full coin collecting tubes with the empty ones, thereby maintaining the normal operation of the ticket machine, coin exchanger or vending machine.

FIG. 1 shows a prior art of a coin dispensing and storing device, which includes a casing 100*a*, coin storage cassettes 106*a*, a front support 132*a* and a rear support 134*a*. A plurality of coin collecting tubes (six shown in this figure) is disposed in the front support 132*a* and the rear support 134*a* respectively. The coin storage cassettes 106*a* containing the front support 132*a* and the rear support 134*a* are pivotally connected to the casing 100*a* by means of a swing-arm hinge 124*a*. FIG. 1 shows that the coin storage cassette 106*a* pivots outwards to depart from the casing 100*a*. The front support 132*a* and the rear support 134*a* are separated from each other by means of a pivot 126*a*. Further, a coin-exiting path 136*a* is defined between the front support 132*a* and the rear support 134*a* for allowing coins to be exited from the casing 100*a*.

However, in practice, such a coin dispensing and storing device still has some drawbacks. Since the coin storage cassette contains a plurality of coin collecting tubes, the total weight of the coin storage cassette is so large when these coin collecting tubes are full of coins. As a result, the swing-arm hinge 124*a* and the pivot 126*a* are subjected to a large stress. Not only the operator has to exert a relatively large force to open the coin storage cassette 106*a*, but also the swing-arm hinge 124*a* and the pivot 126*a* may suffer damage and deformation very easily after a long period of time. Thus, the normal operation and lifetime of the coin dispensing and storing device are affected negatively.

Therefore, it is an important issue for the present Inventor to solve the above-mentioned problems.

SUMMARY OF THE INVENTION

The present invention is to provide a coin dispensing and storing device, in which the coin collecting tubes are supported by different rotatable supports. Thus, not only the operation is labor-saving, but also the force exerting on the respective rotatable supports can be distributed efficiently to reduce the generation of damage and deformation.

The present invention is to provide a coin dispensing and storing device, which includes a coin distributing body, a plurality of coin collecting tubes, a left rotatable support, a pivotal plate and a right rotatable support. The coins are received in the coin collecting tubes. The left rotatable support is pivotally connected to one side of the coin distributing body. The left rotatable support allows a portion of the coin collecting tubes to be disposed therein. The pivotal plate is pivotally connected to the other side of the coin distributing body. The right rotatable support is connected to the pivotal plate. The right rotatable support allows the remaining portion of the coin collecting tubes to be disposed therein. The left rotatable support and the right rotatable support can be pivotally received in the coin distributing body or rotated to the outside of the coin distributing body.

The present invention provides a coin dispensing and storing device, which includes a coin distributing body, a plurality of coin collecting tubes, a left rotatable support and a right rotatable support. The coins are received in the coin collecting tubes. The left rotatable support is pivotally connected to one side of the coin distributing body. The left rotatable support allows a portion of the coin collecting tubes to be disposed therein. The right rotatable support is pivotally connected to the other side of the coin distributing body. The right rotatable support allows the remaining portion of the coin collecting tubes to be disposed therein. The left rotatable support and the right rotatable support can be pivotally received in the coin distributing body or rotated to the outside of the coin distributing body.

In comparison with prior art, the present invention has advantageous features as follows. Since the coin collecting tubes are disposed in the left rotatable support and the right rotatable support respectively, the force exerted on each of the rotatable support and the associated pivots can be distributed, so that the rotatable supports and the pivots of the coin dispensing and storing device do not suffer damage easily and thus their lifetimes can be extended. Also, the operation is labor-saving. On the other hand, with the combination of the pivotal plate and the right rotatable support, the volume of the coin dispensing and storing device can be reduced.

DETAILED DESCRIPTION OF THE INVENTION

The characteristics and technical contents of the present invention will be described with reference to the accompanying drawings. However, the drawings are illustrative only but not used to limit the present invention.

Figure 1:
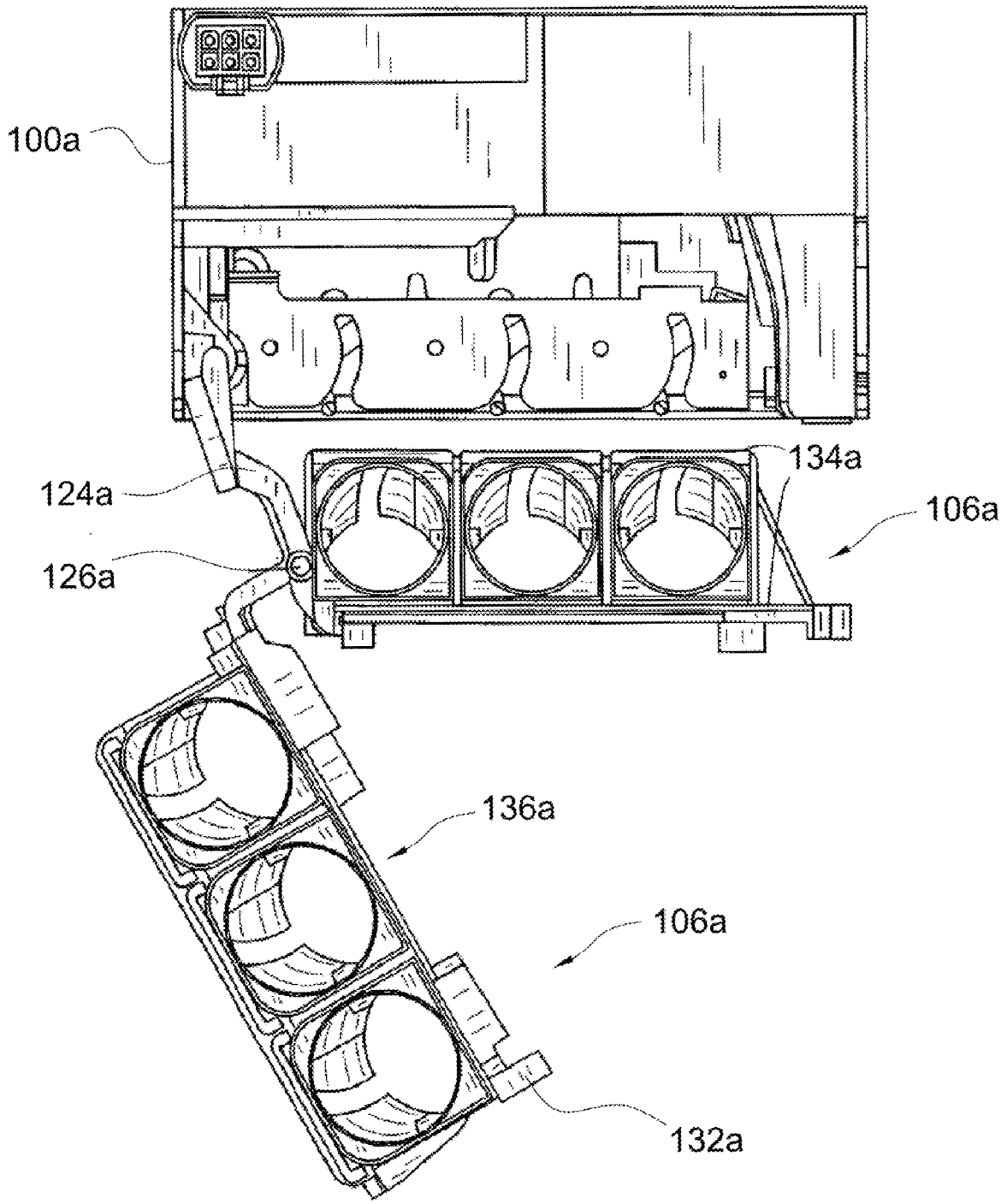
FIG.1 (Prior Art)
FIG. 1 is a top view showing the prior art of a coin storage device.
Figure 2:
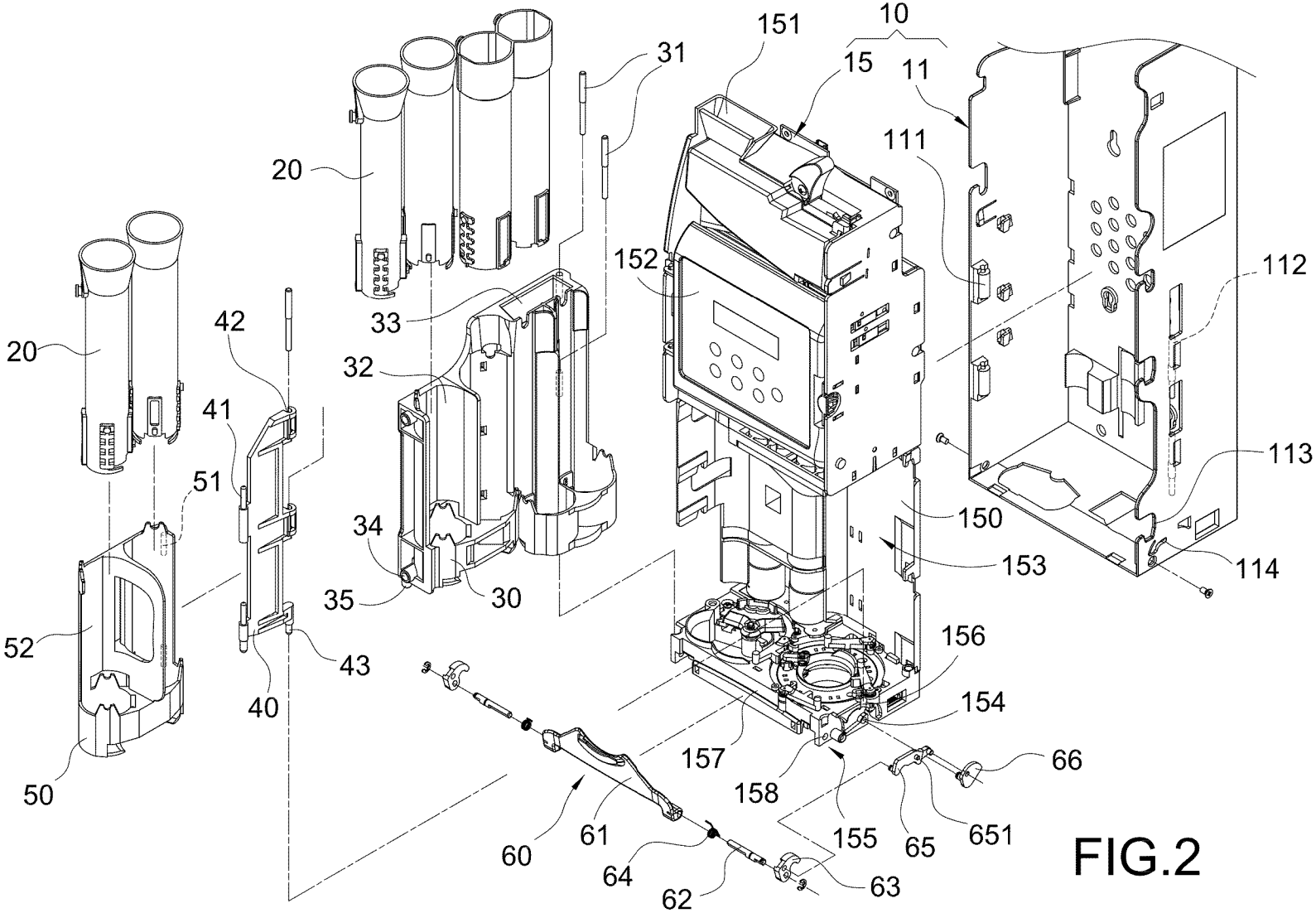
FIG. 2 is an exploded perspective view of the present invention.
Figure 3:
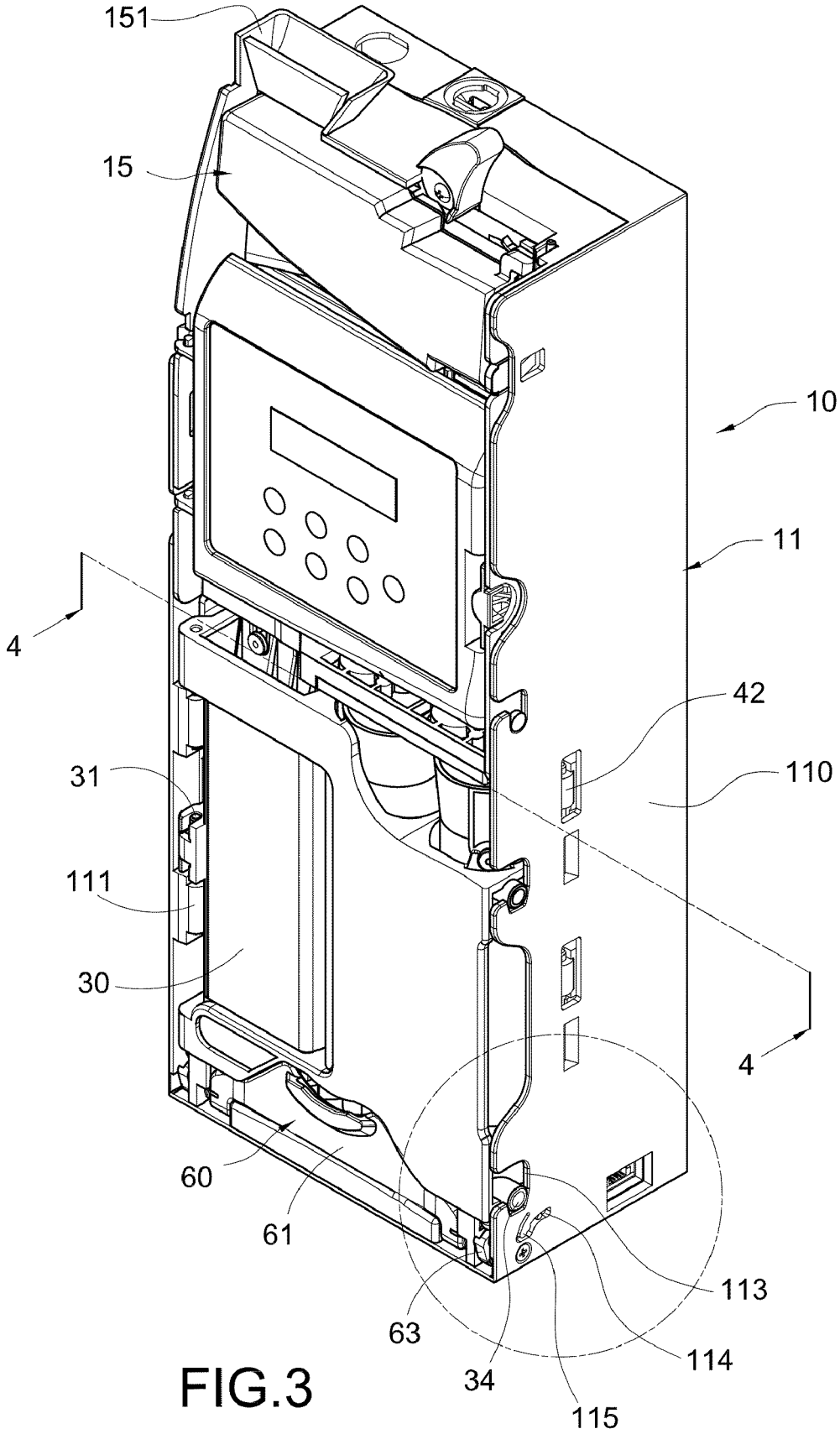
FIG. 3 is an assembled perspective view of the present invention.
Figure 4:
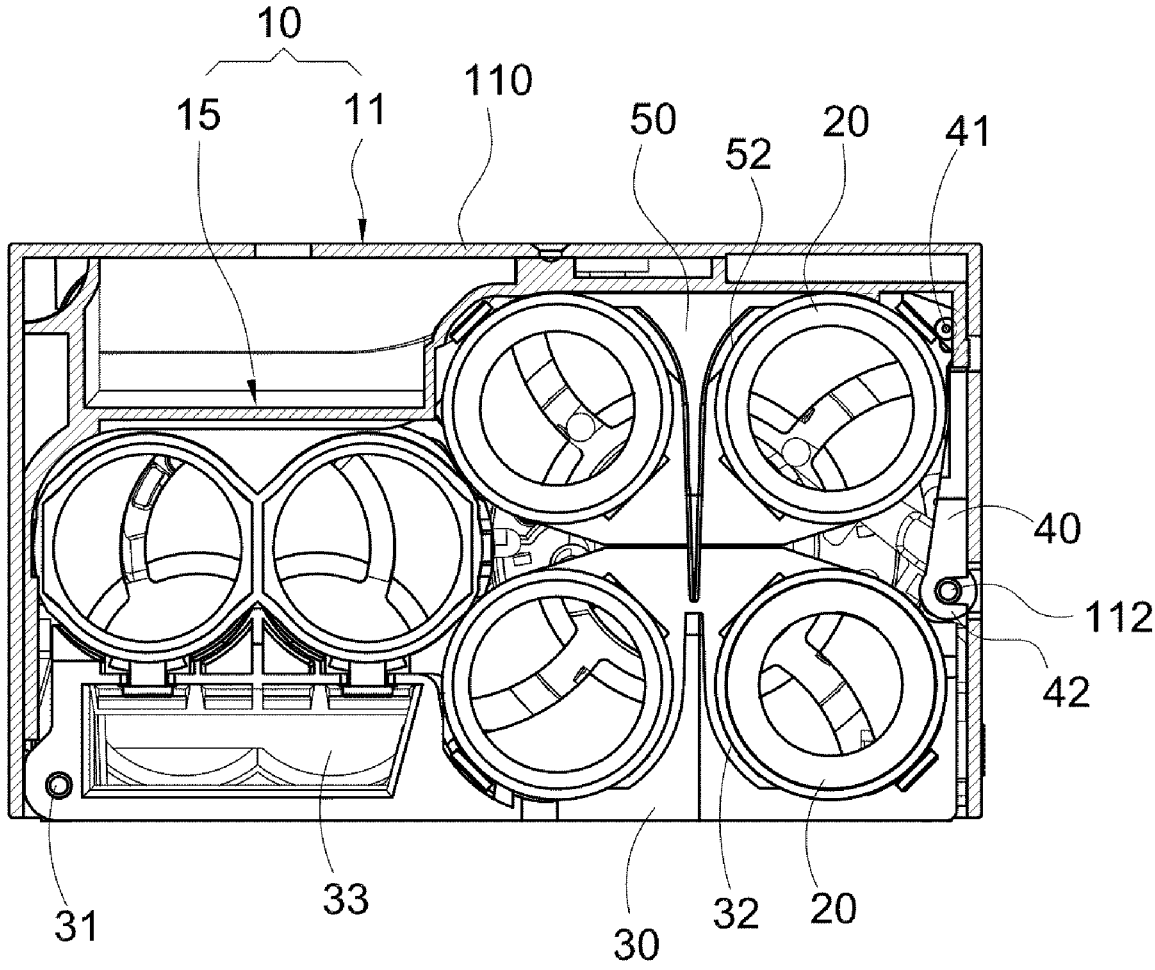
FIG. 4 is a cross-sectional view taken along the line 4-4 in FIG. 3.

Please refer to FIGS. 2 to 4. The present invention provides coin dispensing and storing device, which includes a coin distributing body 10, six coin collecting tubes 20, a left rotatable support 30, a pivotal plate 40 and a right rotatable support 50.

Figure 7:
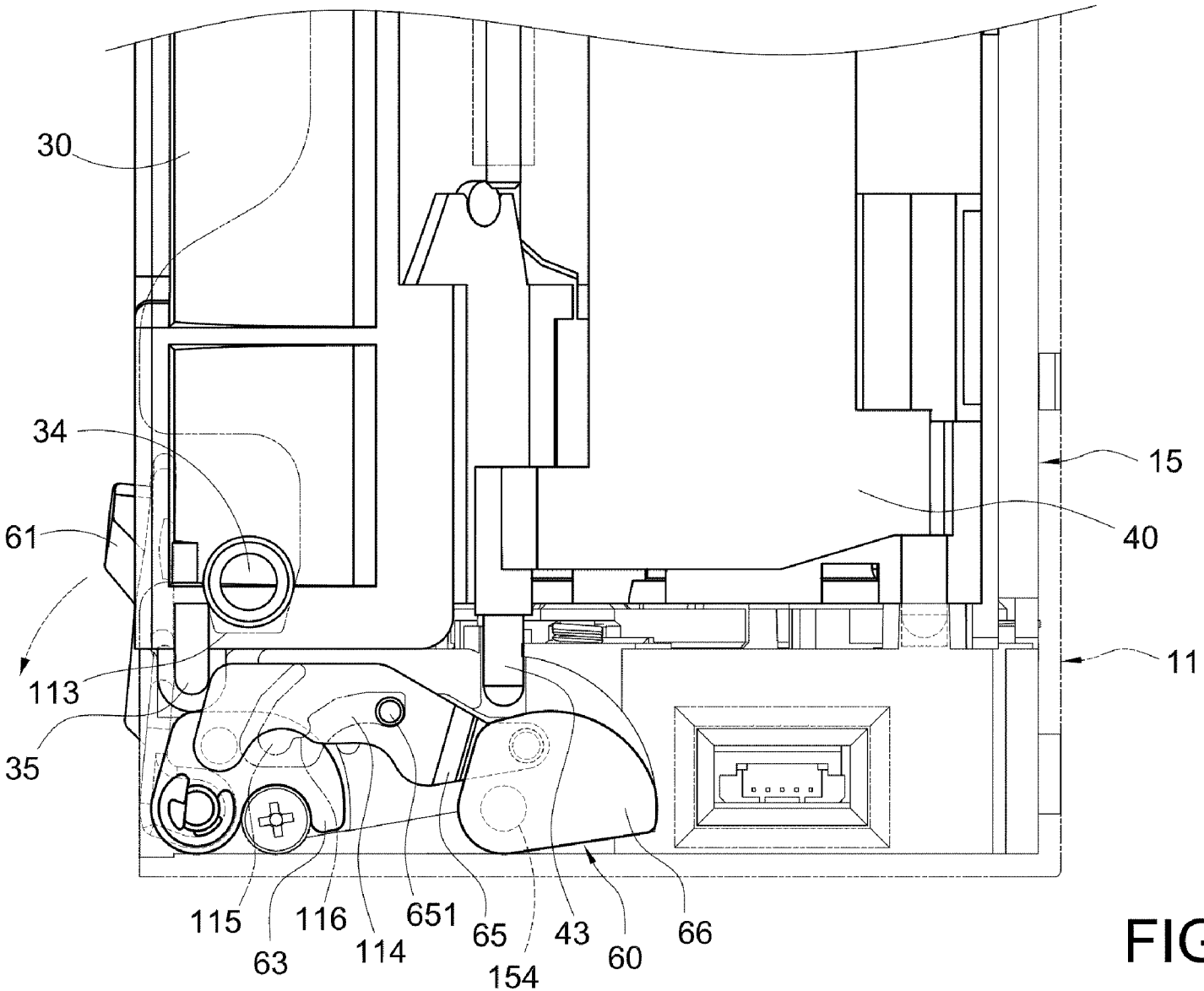
FIG. 7 is a schematic view (I) showing the action of the lifting means of the present invention.

The coin distributing body 10 comprises an outer frame 11 and a coin dispenser 15. The outer frame 11 is enclosed by a plurality of surrounding plates 110 and thus is substantially formed into a rectangular shape. The inner wall of the left-side surrounding plate 110 is provided with two first pivotal holders 11. The inner wall of the right-side surrounding plate 110 is connected with two first pivotal shafts 112. Further, the middle section and the bottom section of the right-side surrounding plate 110 are provided with two positioning notches 113. The bottom section of the right-side surrounding plate 110 is provided with a V-shaped guiding slot 114 and an elastic piece 115 (FIG. 3). The guiding slot 114 beneath the elastic piece 115 is formed with a locking protrusion 116 (FIG. 7).

Figure 5:
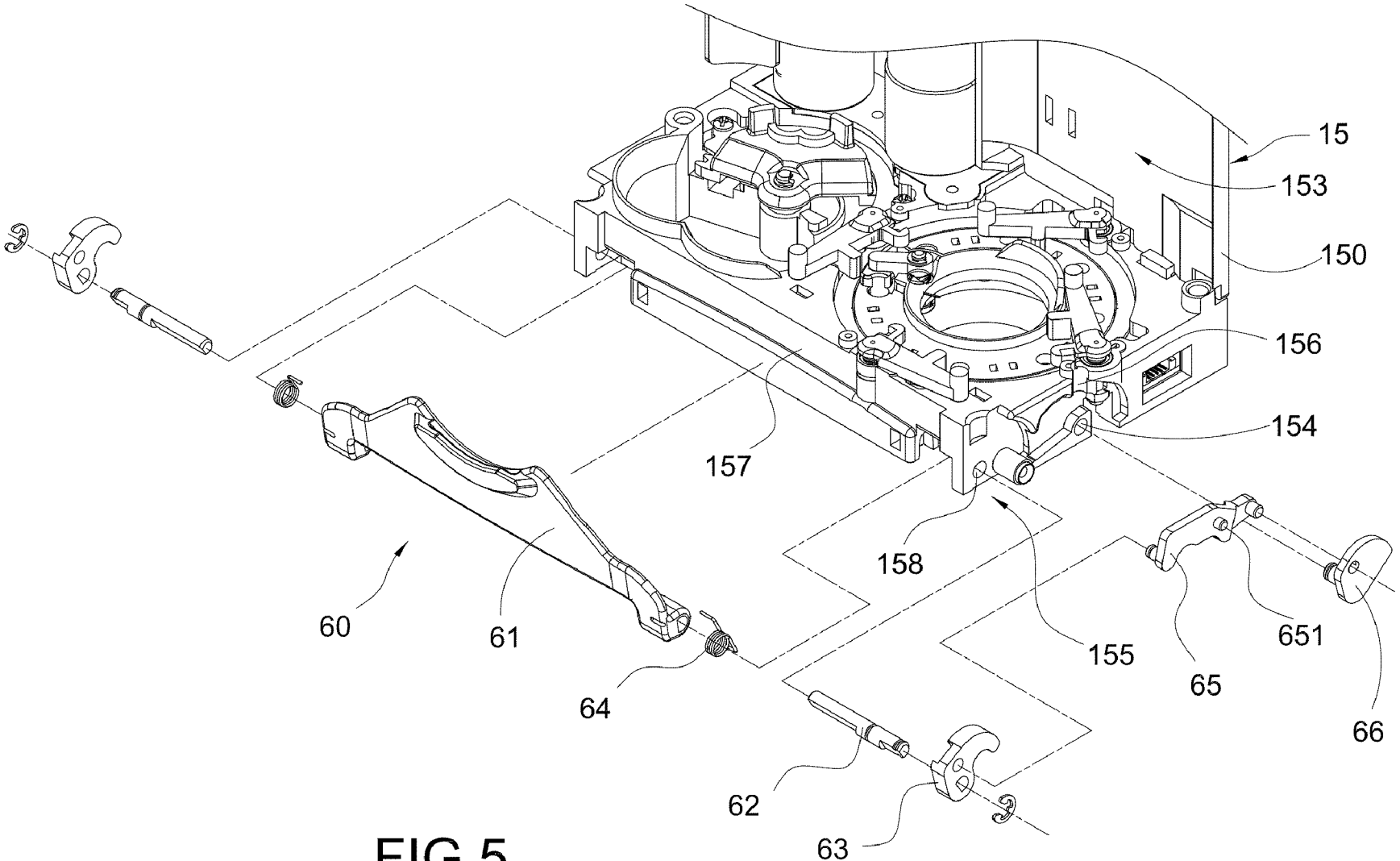
FIG. 5 is an exploded perspective showing the lifting means and the coin dispenser of the present invention.

The coin dispenser 15 is mounted in the outer frame 11 and it comprises an inner frame 150, a coin hopper 151 fixed to the upside of the inner frame 150 for receiving coins, a coin distributing module 152 for distributing the coins received by the coin hopper 151, and an accommodating space 153 formed below the coin distributing module 152. Both sides of the bottom of the inner frame 150 are provided with a shaft hole 154 respectively in the transverse direction of the coin dispensing and storing device. On the front and rear sides of the shaft hole 154, the inner frame 150 is provided with a notch 155 and a through-hole 156 respectively (FIG. 5). The front surface of the inner frame 150 is formed at its bottom with an inner slot 157. Further, the inner frame 150 is provided with a through-hole 158 near the notch 155.

Each of the coin collecting tubes 20 is formed into a hollow cylinder, in which a stack of coins can be received. The size of each coin collecting tube 20 corresponds to the coin diameter of a certain denomination. With a plurality of coin collecting tubes 20 of different sizes, coins of different denominations can be received.

The left rotatable support 30 is connected with two second pivotal shafts 31. The two second pivotal shafts 31 penetrate the two first pivotal holders 111 respectively on the left side of the outer frame 11. The left rotatable support 30 is provided with a plurality of elongate troughs 32 (four in the present embodiment). The profile of each of the elongate troughs 32 is substantially formed into a semi-circular shape for allowing a coin collecting tube 20 to be detachably assembled in the elongate trough 32. Further, in the present embodiment, when the left rotatable support 30 is closed, it is located outside the right rotatable support 50. Therefore, the coin-exiting path 33 is located in the left rotatable support 30 and outside the coin collecting tubes 20. With this arrangement, the coins can be exited to the outside of the coin distributing body 10 easily without interfering with the opening and closing of the left rotatable support 30 and the right rotatable support 50. Of course, the coin-exiting path 33 may not be located in the left rotatable support 30 only and its location can be changed according to practical demands. Further, one end of the left rotatable support 30 away from the second pivotal shaft 31 is provided with two positioning posts 34. The positioning posts 34 can be inserted into the positioning notches 113 for positioning. Moreover, the left and right sides of the bottom of the left rotatable support 30 are provided with a first abutting rod 35. The first abutting rod 35 is located in the notch 155 of the inner frame 150.

The front side of the pivotal plate 40 is provided with two third pivotal shafts 41, and the rear side thereof is provided with two semi-circular second pivotal holders 42. The two second pivotal holders 42 are pivotally connected to the first pivotal shafts 112 on the right side of the outer frame 11. Further, the underside of the second pivotal holder 42 of the pivotal plate 40 is connected with a second abutting rod 43. The second abutting rod 43 penetrates the through-hole 156 of the inner frame 150.

One side of the right rotatable support 50 adjacent to the pivotal plate 40 is formed with two third pivotal holders 51. The two third pivotal holders 51 allow the third pivotal shafts 41 to be penetrated therein. With this arrangement, when the pivotal plate 40 causes the right rotatable support 50 to be received in the accommodating space 153, the right rotatable support 50 can rotate with respect to the pivotal plate 40 to form a substantially right angle there between, so that the right rotatable support 50 can abut the rear portion of the inner wall of the outer frame 11 (FIG. 4). Further, the right rotatable support 50 is also provided with a plurality of elongate troughs 52 (two in the present embodiments). The profile 52 of each elongate trough 52 is substantially formed into a semi-circular shape, in which a coin collecting tube 20 can be detachably assembled.

Figure 6:
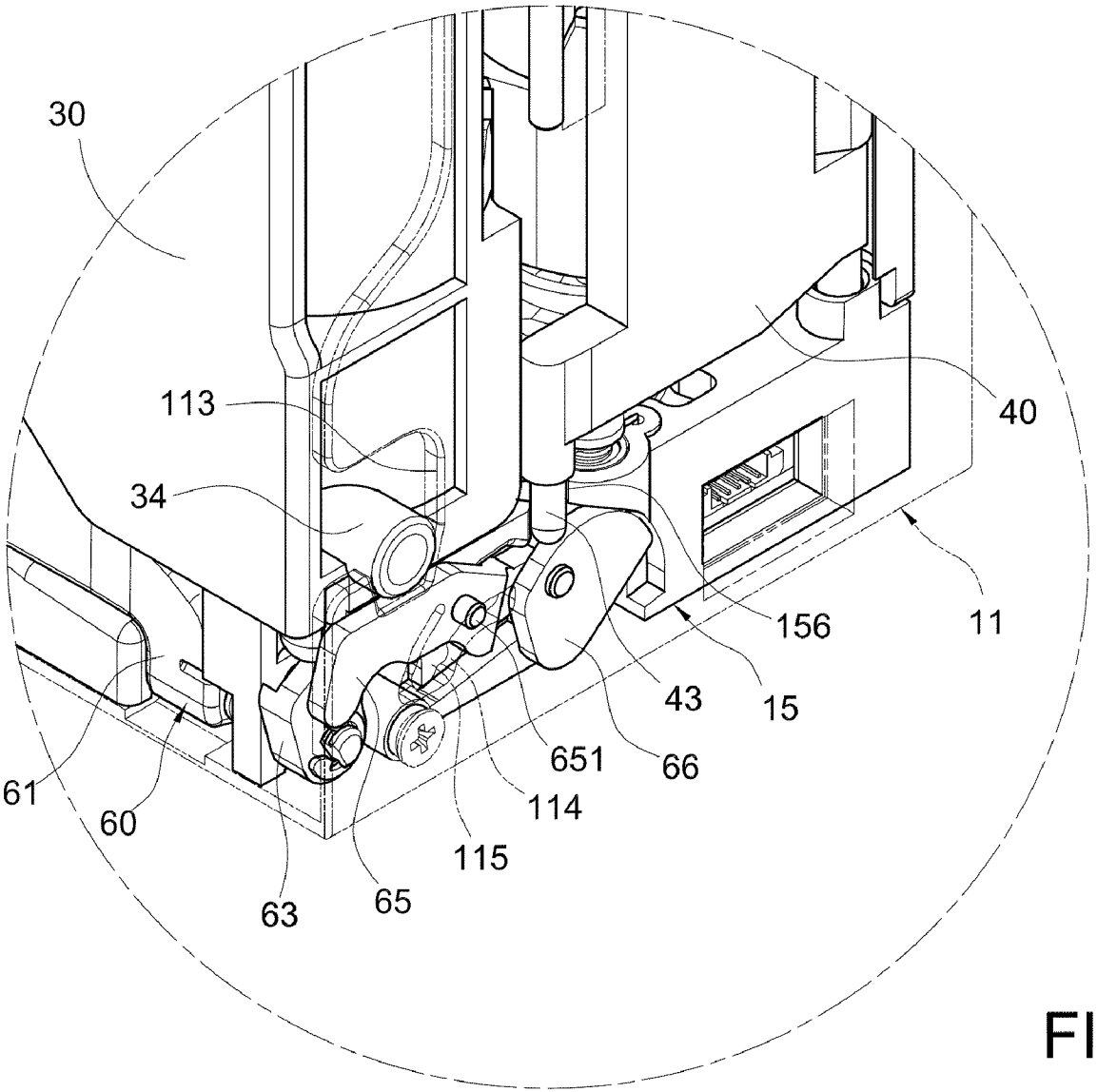
FIG. 6 is a partially enlarged view showing that the lifting means installed in the coin dispenser of the present invention.

Please refer to FIGS. 5 and 6. The coin dispensing and storing device of the present invention further includes a lifting means 60, which includes a handle 61, a pair of shaft rods 62, a pair of front lifting cams 63 and a pair of torsion springs 64. The handle 61 is flat and elongate, and it is connected to the inner slot 157. The shaft rods 62 penetrate the through-holes 158 and then are fixed to the left and right ends of the handle 61 respectively, so that the handle 61 can be swung with respect to the inner frame 150. Each of the front lifting cams 63 are fixedly connected to one end of the shaft rod 62 away from the handle 61. The shaft rod 62 penetrates the torsion spring 64. Both ends of the torsion spring 64 abut the inner frame 150 and the handle 61 respectively, whereby the handle 61 can return to its original position by means of the elastic forces of the torsion springs 64 (FIG. 7).

The front lifting cam 63 is located to face the first abutting rod 35 of the left rotatable support 30. The upward swinging action of the handle 61 causes each front lifting cam 63 to lift the first abutting rod 35, whereby the positioning posts 34 of the left rotatable support 30 can be removed from the positioning notches 113 of the outer frame 11. Further, in the present embodiment, the lifting means 60 further comprises a connecting arm 65 and a rear lifting cam 66. The connecting arm 65 is pivotally connected to the front lifting cam 63 on the right side of the inner frame 150. The rear lifting cam 66 is pivotally connected to the shaft hole 154 of the inner frame 150 and the connecting arm 65, and it is located to correspond to the through-hole 156 of the inner frame 150 and the second abutting rod 43 of the pivotal plate 40. The upward swinging actions of the handle 61 and the front lifting cam 63 cause the rear lifting cam 66 to lift the second abutting rod 43. Further, in the present embodiment, the connecting arm 65 is formed with a post 651 that can be received in the guiding slot 114 of the outer frame 11 (FIG. 7). With the deformation of the elastic piece 115 and the stopping action exerted by the locking protrusion 116 to the post 651, the effect of locking and positioning the left and right rotatable supports can be achieved.

Figure 8:
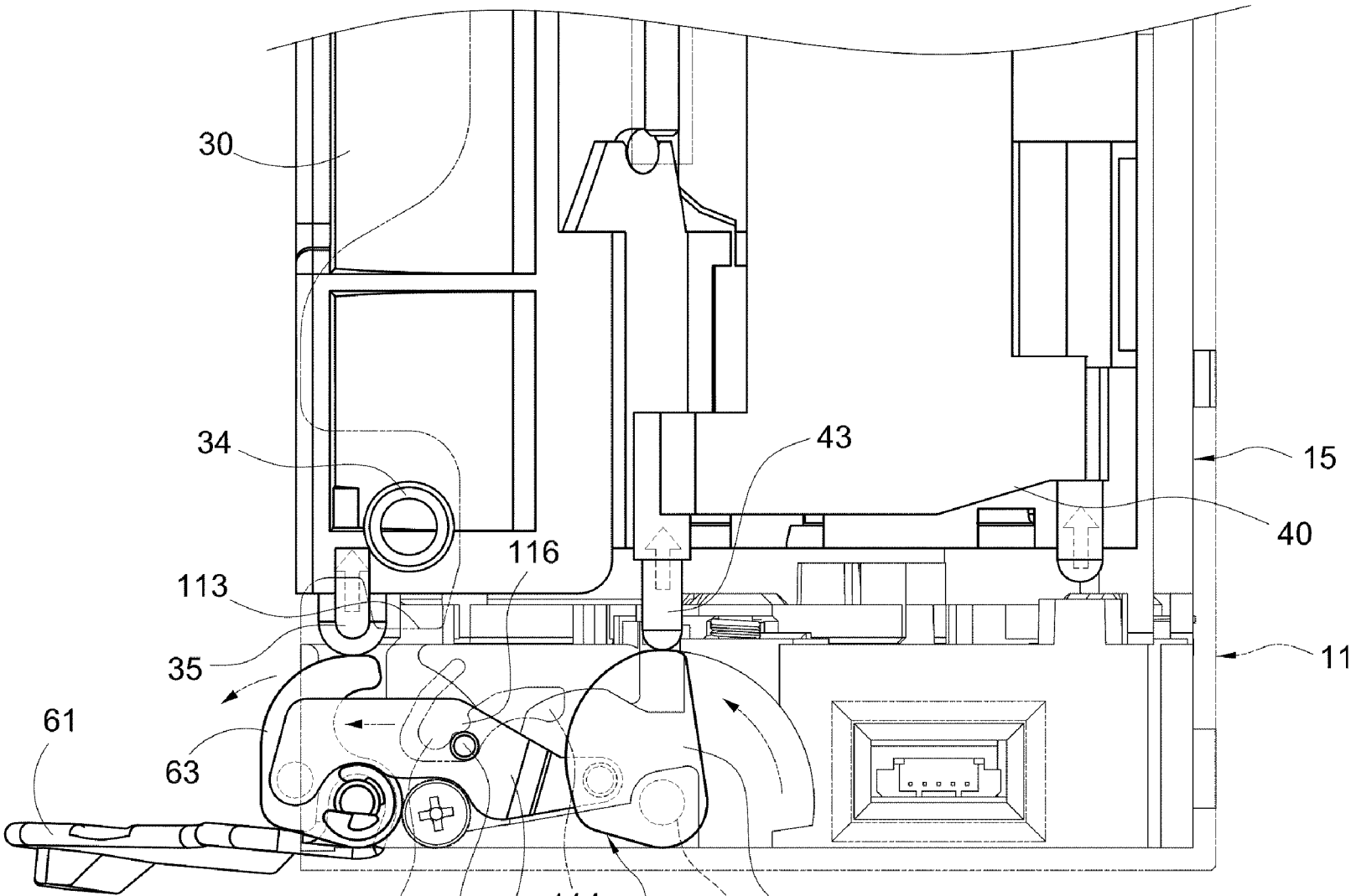
FIG. 8 is a schematic view (II) showing the action of the lifting means of the present invention.
Figure 9:
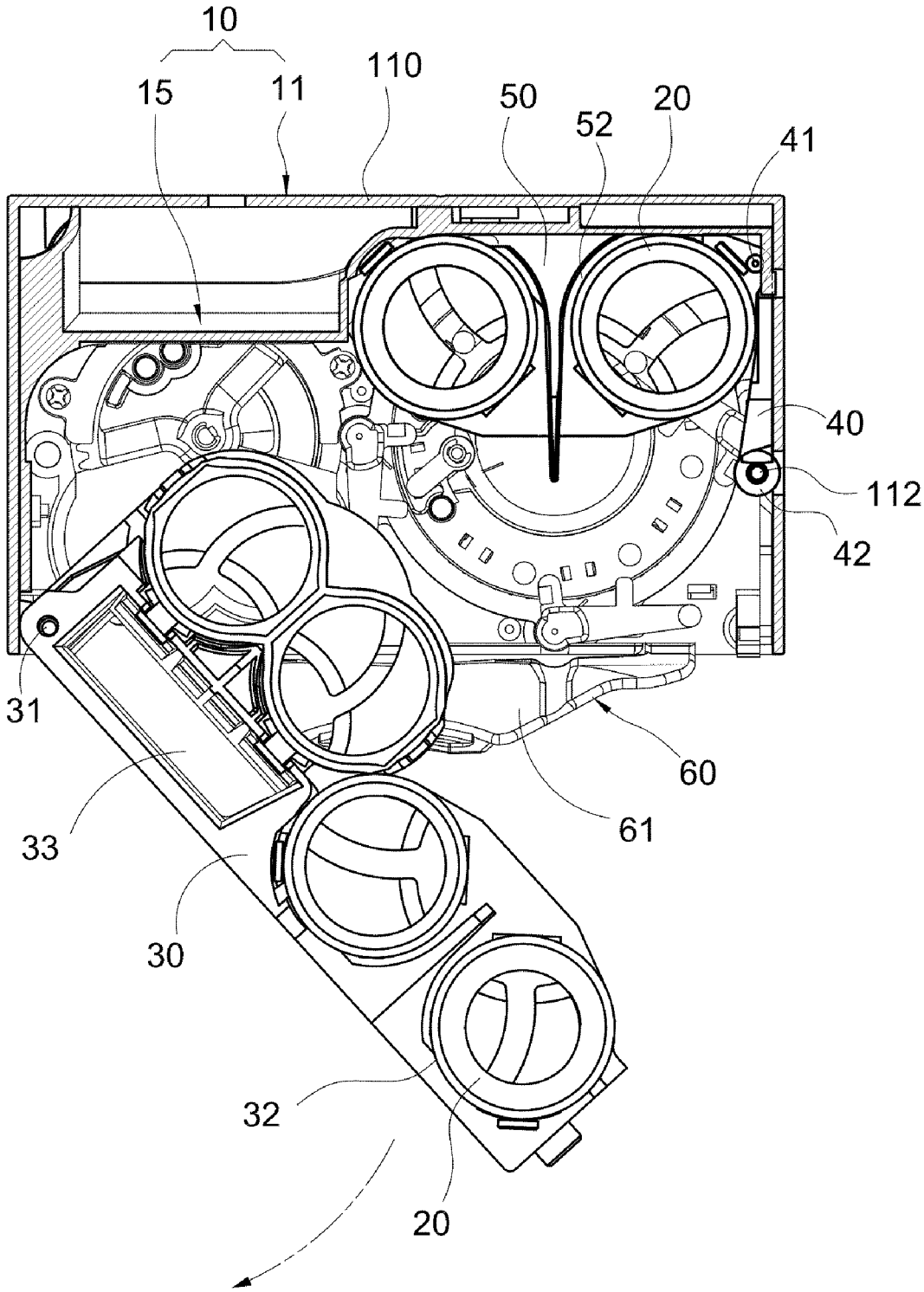
FIG. 9 is a schematic view showing the outward rotation of the left rotatable support of the present invention.
Figure 10:
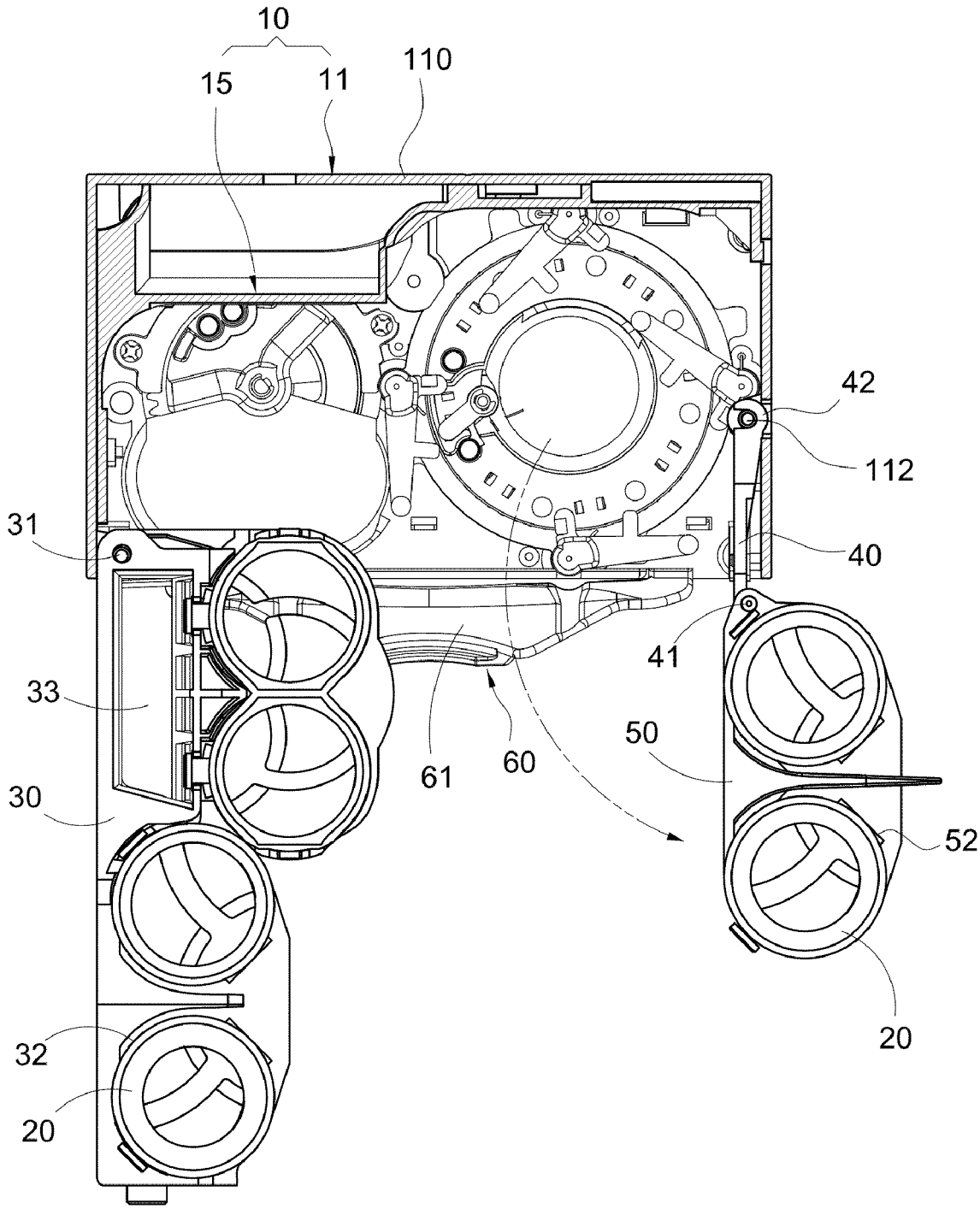
FIG. 10 is a schematic view showing the outward rotation of the right rotatable support of the present invention.
Figure 11:
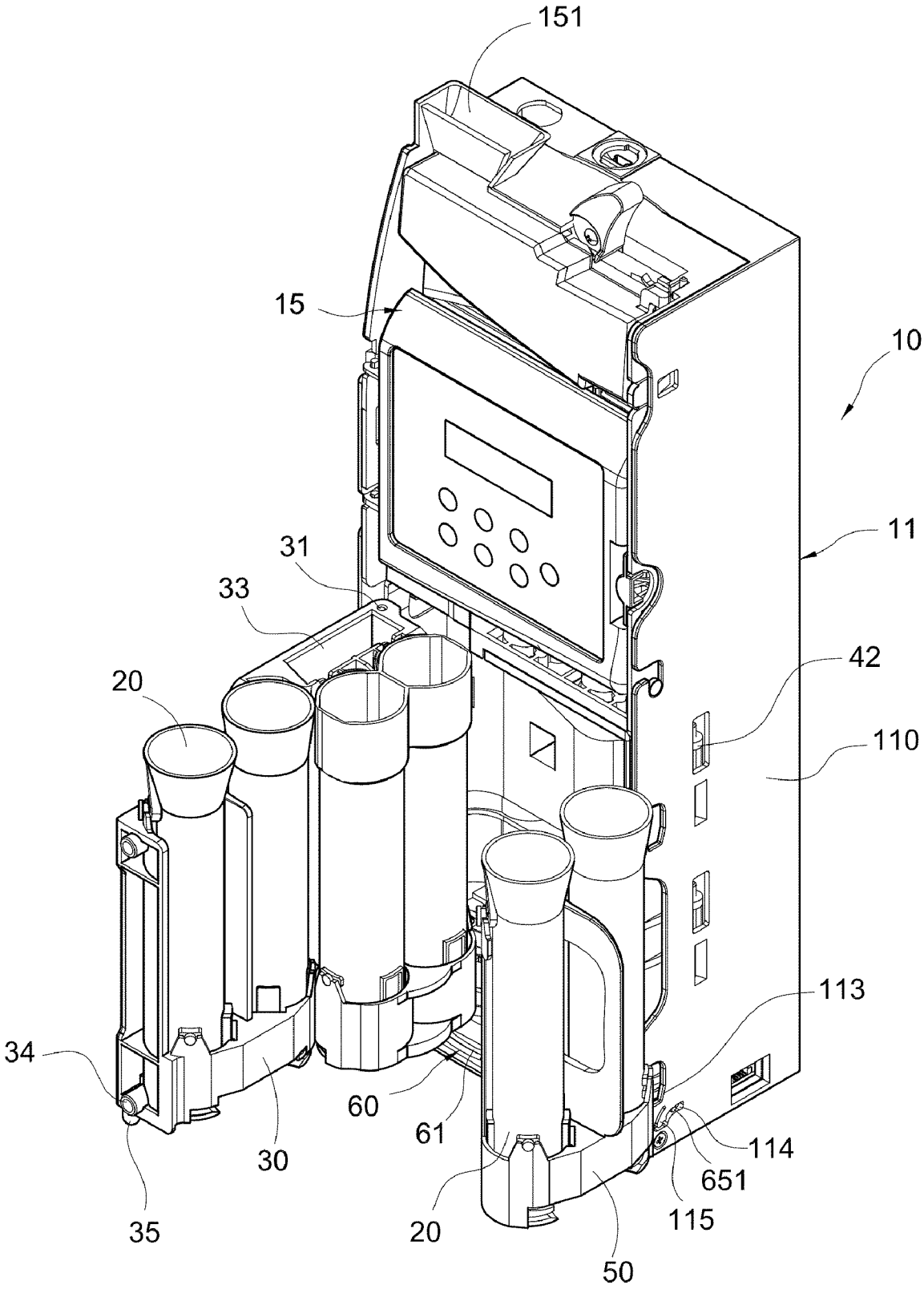
FIG. 11 is a perspective view showing the external appearance of the present invention after both the left and right rotatable supports are rotated outwards.

Please refer to FIGS. 7 to 11. When the operator intends to open the coin dispensing and storing device, the operator first grips the handle 61 and exerts a force to make the handle 61 to swing by using the shaft rod 62 as the center of rotation, whereby both of the front lifting cams 63 can rotate upwards. At this time, the front lifting cams 63 lift the first abutting rods 35, so that the positioning posts 34 of the left rotatable support 30 can be removed from the positioning notches 113 of the outer frame 11 (FIG. 3). Then, since the right side of the left rotatable support 30 has been removed from the outer frame 11, the left rotatable support 30 can be swung outwards to leave the accommodating space 153 of the inner frame 150 by using the second pivotal shaft 31 as the center of rotation (FIGS. 9 and 11). Similarly, with the combination of the connecting arm 65 and the rear lifting cam 66, the upward rotation of the front lifting cam 63 causes the connecting arm 65 to move and makes the rear lifting cam 66 to lift the second abutting rod 43. In this way, the pivotal plate 40 and the right rotatable support 50 are lifted from the inner frame 150. At this time, the right rotatable support 50 can be swung outwards with respect to the pivotal plate 40 and the outer frame 11, so that the right rotatable support 50 can be swung outwards from the accommodating space 153 of the inner frame 150 (FIG. 10).

Further, since the surrounding plate 110 of the outer frame 11 is provided with the guiding slot 114, the elastic piece 115 and the locking protrusion 116, the traveling path of the connecting arm 65 is restricted by its post 651 sliding in the guiding slot 114. Therefore, as shown in FIG. 8, when the handle 61 is swung to the lowest location, it can be positioned because the locking protrusion 116 applies a stopping action to the post 651. Thus, the respective coin collecting tubes 20 can be removed from the left rotatable support 30 and the right rotatable support 50 easily. On the other hand, after the respective coin collecting tubes 20 are installed into the left rotatable support 30 and the right rotatable support 50, and the right rotatable support 50 is pushed into the accommodating space 153, the operator can push the handle 61 back, so that the post 651 can pass through the locking protrusion 116 by means of the elastic deformation of the elastic piece 115 and move along the guiding slot 114 to return to its original position. At this time, the left rotatable support 30 and the right rotatable support 50 are restricted and positioned again by the outer frame 11 or the inner frame 150.

Further, the present invention has another embodiment, which is substantially identical to the previous embodiment in structure. For simplicity, the redundant description is omitted and only the difference there between is explained. The third shaft holders 51 of the right rotatable support 50 are pivotally connected to the pivotal shafts 112 on the right side of the outer frame 11 (not shown). At this time, the right rotatable support 50 rotates outwards or inwards directly with respect to the outer frame 11. Such an arrangement can be adopted based on the type of the coin dispensing and storing device. Also, the present embodiment has the same effect as that of the previous embodiment.

According to the above, the coin dispensing and storing device according to the present invention really demonstrates industrial applicability, novelty and inventive steps. Further, the structure of the present invention has not been seen in product of the same kind or let in public use. Thus, the present invention conforms to the requirements for a utility model patent.

What is claimed is:

1. A coin dispensing and storing device, comprising:

a coin distributing body (10);

a plurality of coin collecting tubes (20) for allowing coins to be received therein;

a left rotatable support (30) pivotally connected to one side of the coin distributing body (10), a portion of the coin collecting tubes (20) being disposed in the left rotatable support (30);

a lifting means (60) mounted in the bottom of the coin distributing body (10) and disposed to correspond to the left rotatable support (30) for lifting the left rotatable support (30);

a pivotal plate (40) pivotally connected to the other side of the coin distributing body (10); and a right rotatable support (50) connected to the pivotal plate (40), the remaining portion of the coin collecting tubes (20) being received in the right rotatable support (50), wherein the left rotatable support (30) and the right rotatable support (50) are pivotally received in the coin distributing body (10) or rotated to the outside of the coin distributing body (10).

2. The coin dispensing and storing device according to claim 1, wherein the coin distributing body (10) comprises an outer frame (11) and a coin dispenser (15) inside the outer frame (11).

3. The coin dispensing and storing device according to claim 2, wherein an inner wall of the outer frame (11) is provided with a first shaft holder (111) and a first pivotal shaft (112), the left rotatable support (30) has a second pivotal shaft (31) penetrating the first shaft holder (111), the pivotal plate (40) has a second shaft holder (42) for allowing the first pivotal shaft (112) to penetrate therein.

4. The coin dispensing and storing device according to claim 3, wherein the pivotal plate (40) has a third pivotal shaft (41), the right rotatable support (50) has a third shaft holder (51) for allowing the third pivotal shaft (41) to penetrate therein, thereby receiving the right rotatable support (50) in the coin dispenser (15).

5. The coin dispensing and storing device according to claim 2, wherein the outer frame (11) is provided with a positioning notch (113), the left rotatable support (30) is formed with a positioning post (34) for inserting into the positioning notch (113).

6. The coin dispensing and storing device according to claim 1, wherein the left rotatable support (30) is provided with a coin-exiting path (33) outside the coin collecting tubes (20).

7. The coin dispensing and storing device according to claim 1, wherein the left rotatable support (30) has a first abutting rod (35), the lifting means (60) comprises a handle (61), a shaft rod (62) pivotally connected to the coin distributing body (10) and fixed to the handle (6301), a front lifting cam (63) fixed to the shaft rod (62) for pushing the first abutting rod (35), and a torsion spring (64) provided outside the shaft rod (62) and elastically abutting the handle (61) and the coin distributing body (10).

8. The coin dispensing and storing device according to claim 1, further comprising a lifting means (60) mounted in the bottom of the coin distributing body (10) and disposed to correspond to the left rotatable support (30) and the pivotal plate (40) for lifting the left rotatable support (30) and the pivotal plate (40).

9. The coin dispensing and storing device according to claim 8, wherein the left rotatable support (30) has a first abutting rod (35), the pivotal plate (40) has a second abutting rod (43), the lifting means (60) comprises a handle (61), a shaft rod (62) pivotally connected to the coin distributing body (10) and fixed to the handle (61), a front lifting cam (63) fixed to the shaft rod (62) for pushing the first abutting rod (35), a torsion spring (64) provided outside the shaft rod (62) and elastically abutting the handle (61) and the coin distributing body (10), a connecting arm (65) pivotally connected to the front lifting cam (63) and guided by the coin distributing body (10), and a rear lifting cam (66) pivotally connected to the coin distributing body (10) and the connecting arm (65) for pushing the second abutting rod (43).

10. The coin dispensing and storing device according to claim 9, wherein the coin distributing body (10) comprises an outer frame (11), the outer frame (11) is provided with a guiding slot (114) at a position corresponding to the connecting arm (65), the connecting arm (65) is formed with a post (651) sliding in the guiding slot (114).

11. The coin dispensing and storing device according to claim 10, wherein the guiding slot (114) of the outer frame (11) is formed with an elastic piece (115), the elastic piece (115) is formed with a locking protrusion (116) in the guiding slot (114) for stopping the movement of the post (651).

12. A coin dispensing and storing device, comprising:

a coin distributing body (10);

a plurality of coin collecting tubes (20) for allowing coins to be received therein;

a left rotatable support (30) pivotally connected to one side of the coin distributing body (10), a portion of the coin collecting tubes (20) being disposed in the left rotatable support (30);

a lifting means (60) mounted in the bottom of the coin distributing body (10) and disposed to correspond to the left rotatable support (30) for lifting the left rotatable support (30); and a right rotatable support (50) pivotally connected to one side of the coin distributing body (10), the remaining portion of the coin collecting tubes (20) being received in the right rotatable support (50), wherein the left rotatable support (30) and the right rotatable support (50) are pivotally received in the coin distributing body (10) or rotated to the outside of the coin distributing body (10).

13. The coin dispensing and storing device according to claim 12, wherein the coin distributing body (10) comprises an outer frame (11) and a coin dispenser (15) inside the outer frame (11).

14. The coin dispensing and storing device according to claim 13, wherein the outer frame (11) is provided with a positioning notch (113), the left rotatable support (30) is formed with a positioning post (34) for inserting into the positioning notch (113).

15. The coin dispensing and storing device according to claim 12, wherein the left rotatable support (30) is provided with a coin-exiting path (33) outside the coin collecting tubes (20).

16. The coin dispensing and storing device according to claim 13, wherein the left rotatable support (30) has a first abutting rod (35), the lifting means (60) comprises a handle (61), a shaft rod (62) pivotally connected to the coin distributing body (10) and fixed to the handle (61), a front lifting cam (63) fixed to the shaft rod (62) for pushing the first abutting rod (35), and a torsion spring (64) provided outside the shaft rod (62) and elastically abutting the handle (61) and the coin distributing body (10).

17. The coin dispensing and storing device according to claim 12, further comprising a lifting means (60) mounted in the bottom of the coin distributing body (10) and disposed to correspond to the left rotatable support (30) and the right rotatable support (50) for lifting the left rotatable support (30) and the right rotatable support (50).

* * * * *